United States Patent [19]

Zanello et al.

[11] Patent Number: 4,635,649

[45] Date of Patent: Jan. 13, 1987

[54] ELECTRICALLY OPERATED SELF-CLEANING ASHTRAY

[76] Inventors: Gastone Zanello, Via Montere le 10, Pordenone; Giovanni Zago, Via N. Aprilis 41, San Quirino; Giovanni Prataviera, Via Caorle 4, Pordenone, all of Italy

[21] Appl. No.: 698,727

[22] Filed: Feb. 6, 1985

[30] Foreign Application Priority Data

Feb. 14, 1984 [IT] Italy ..... 41527 A/84

[51] Int. Cl.[4] ..... A24F 19/00

[52] U.S. Cl. ..... 131/237; 131/231; 131/235.1

[58] Field of Search ..... 131/237, 231, 232, 235.1, 131/242

[56] References Cited

U.S. PATENT DOCUMENTS

| | | | |
|---|---|---|---|
| 2,359,685 | 10/1944 | Schwartz | 131/237 |
| 2,573,391 | 10/1951 | Bohanos | 131/237 |
| 2,738,878 | 3/1956 | Lundy | 131/235.1 |
| 2,771,885 | 11/1956 | Walker | 131/237 |
| 3,966,442 | 6/1976 | Waters | 131/231 |

FOREIGN PATENT DOCUMENTS

| | | | |
|---|---|---|---|
| 517211 | 1/1940 | United Kingdom | 131/237 |

*Primary Examiner*—V. Millin
*Assistant Examiner*—H. Macey
*Attorney, Agent, or Firm*—Guido Modiano; Albert Josif

[57] ABSTRACT

This invention relates to an electrically operated self-cleaning ashtray comprising a moving web which has a flat area adapted to receive ash and any unburned residue and a discharge area overlying a collecting bin.

A drive enables quick replacement or cleaning of the flat area, and a spray device is provided to deodorize the ashtray.

13 Claims, 5 Drawing Figures

ELECTRICALLY OPERATED SELF-CLEANING ASHTRAY

BACKGROUND OF THE INVENTION

This invention relates to an electrically operated self-cleaning ashtray.

Currently known are ashtrays which have an ash and cigarette butt collecting deck mounted removably above a collecting tray.

Said deck is usually caused to slide, or is pivoted by means of a manually operated mechanical element, said element including, in some cases, a worm gear associated with a spring which acts on a ring nut connected to the deck.

Such known elements are not devoid of disadvantages due to both inconvenient size and the mechanical actuating system.

Furthermore, the collecting deck is bound to retain marks and ash residue, which besides being unsightly, is the cause for odours or smoke emanating into the ambient environment.

SUMMARY OF THE INVENTION

It is the primary aim of this invention to provide an ashtray which can remove any solid residue from tobacco combustion as well as any unburned butts.

A further important object is to arrange for the collecting deck to exhibit the same initial characteristics of cleanliness after such removal.

Another object is to provide an ashtray which does not release odours from ash and butts to the ambient environment.

Another object is to provide an ashtray wherein the mechanical actuation is not imparted by the user.

These and other objects such as will be apparent hereinafter are achieved by a self-cleaning ashtray characterized in that it comprises a box-like case containing a motor, the corresponding power supply source, at least one spray device, and a collecting bin, said motor driving a plurality of rollers wherearound a moving web is trained, said web having a flat renewable area adapted to receive ash and any unburned residue, and a discharge area overlying the collecting bin, said motor and said spray device being controlled from the outside.

BRIEF DESCRIPTION OF THE DRAWINGS

Further features and advantages of the invention will be apparent from the following description of a preferred, but not exclusive, embodiment of this ashtray, with reference to the accompanying illustrative drawings, where.

DESCRIPTION OF THE PREFERRED EMBODIMENTS

Figure 1:
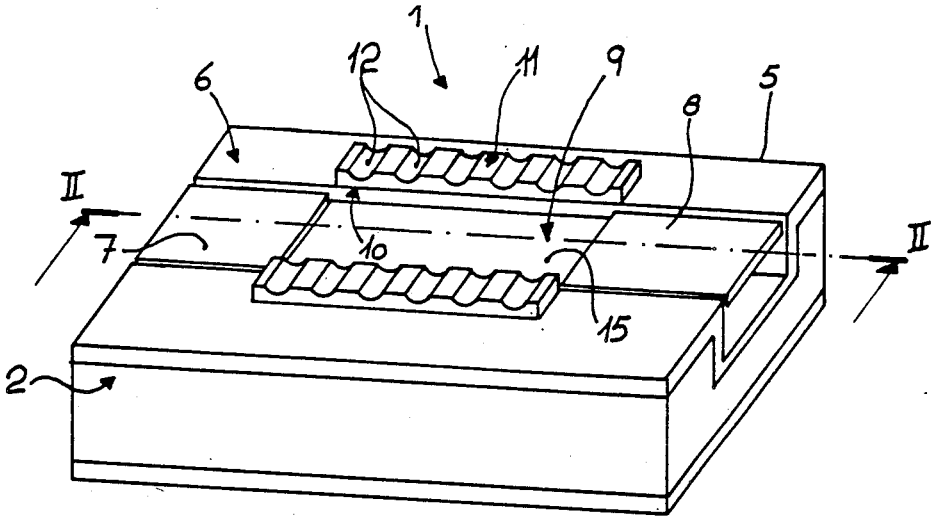
FIG. 1 is a perspective view of the ashtray.
Figure 2:
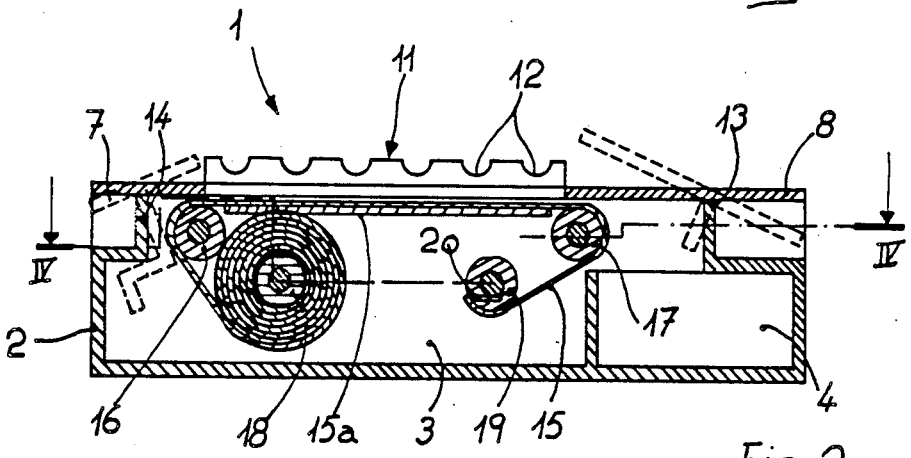
FIG. 2 is a view in the sectional plane II—II of FIG. 1.

Making reference to the previously cited figures, the self-cleaning electrically operated ashtray 1 comprises a substantially parallelepipedal box-like case 2 with two compartments 3 and 4 in its interior, closed at the top in the two side faces 5, the center area 6 being engaged by two partway tiltable segments or actuation elements 7 and 8, an opening 9 being present between the two.

The parallelepipedal segment or first actuation element 7 with rectangular base has a width equal approximately to two thirds of the corresponding case 1, its length being equal to about one quarter of the same.

The segment or second actuation element 8 has similar a shape to the segment 7, its length reaching one third of that of the case 1.

At the sides 10 of the rectangular opening 9 there are located two holders 11 for cigarettes, formed by two parallelepipedal uprights having depressions 12 with semicircular cross-sections.

The segments 7 and 8 are hingedly connected at the bottom to supports 13 and 14 located on the case 2, said supports allowing rotation of the segments about their transverse mid-axes.

At the center area 6, between the segments 7 and 8, there is provided a moving web 15 of not inflammable material, located in the opening 9, having the same cross dimension, partly trained around two rollers 16 and 17 located respectively below the segments 7 and 8 and having mutually parallel axes lying on the same parallel plane as the top of the case 1.

On a slightly lower plane, there are located two additional rollers 18 and 19 parallel to each other and to the former, placed at a smaller mutual distance than that separating the roller 16 from the roller 17, the roller 18 having the web 15 wound several times around it, the roller 19 having one end of the web 15 engaged in a groove 20, shaped to match therewith.

Said rollers 16,17,18 and 19 have the ends of the respective axes 21 pivoted on walls **22,22*a*** extending perpendicularly thereto.

The rollers 17 and 19 are each pivoted, at the same end, to toothed gear wheels 23 and 24 respectively, said gear wheels 23,24 being interconnected, the latter being driven by an electric motor 25 operated through the segment 8, by a plurality of electric batteries 26, located on the opposite side of the compartment 3 to said motor 25, and serially connected to one another. The batteries are connected to the motor through a circuit, not shown, including a switch actuated by the tiltable segment 8.

The roller 17, is located above the compartment 4 for collecting ash and any butts, having a width corresponding to the width of the case 1.

In the center area 9, below the web 15, there is located a fixed bearing deck **15*a* having a slightly shorter longitudinal extension than that of the area 9**, but defining the same width thereas.

The segment 7 controls, through its part tilting movement, the valve 27 of a spray device 28, the latter being placed alongside the wall 22 of the compartment 3, on the same side as the motor 25, but being separated therefrom by a wall 29 perpendicular to the wall 22 and enclosed within the compartment 3.

Operation is as follows: the flat area of the web functions as a supporting surface for ash and butts, their removal being controlled by the segment 8 which, by being tilted, by acting on the opposite end to that partly covering the web, actuates the motor 25 through switch means, not shown, and hence the gear wheels. Thus the web unwinds from the roller 18 and winds around the roller 19, emptying any residue and any unburned butts into the collecting compartment or bin 4, presenting again a clean flat area at the opening 9, at this point it being possible to relocate the segment 8 to the starting position.

By acting instead on the segment 7, again tilting it by pressing on the opposite end to that partly covering the web, the valve of the underlying atomizer is depressed, and accordingly, the web is deodorized.

Figure 3:
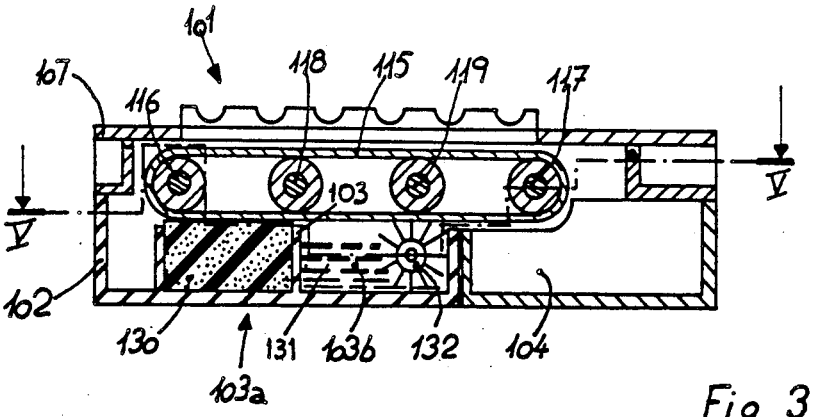
FIG. 3 is a view similar to the preceding one but of a second embodiment.
Figure 4:
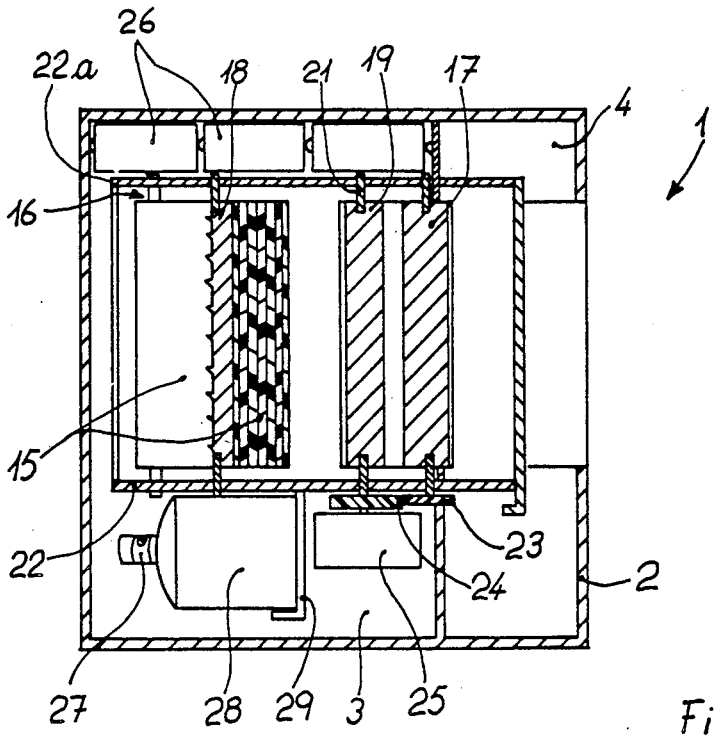
FIG. 4 is a view in the sectional plane IV—IV of FIG. 2.
Figure 5:
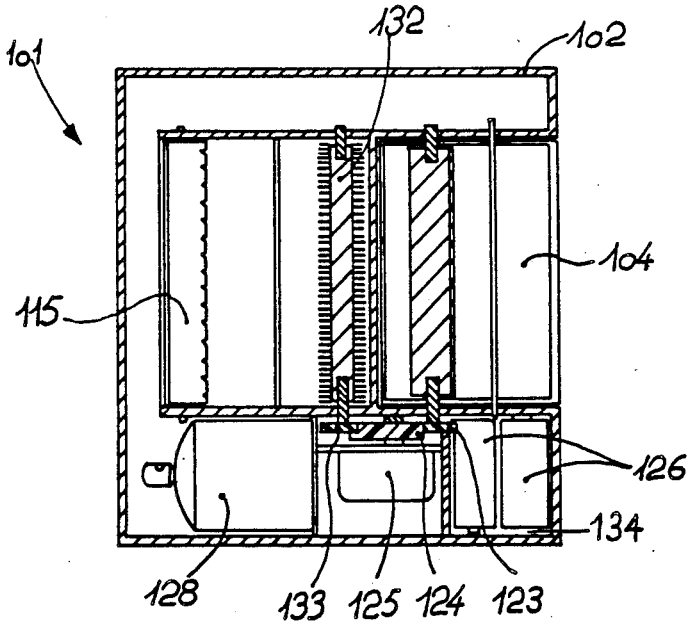
FIG. 5 is a view in the sectional plane V—V of FIG. 3.

A modification is shown in FIGS. 3 and 5: the case 102 of the ashtray 101 remains outwardly structurally the same, excepting that the collecting bin 104 is removable therefrom.

Still present is a web 115, which is, however, continuously trained around four rollers 116,117,118 and 119 having the axes 121 parallel and all lying in the same plane.

The compartment 103 is divided into two segments: in the segment 103*a* there is located a sponge 130 which wipes the top of the web 115, the contiguous segment 103*b* containing instead a detergent liquid 131.

Partly immersed in that liquid is another roller 132 having on the lateral surface thereof, a brush or scraping side surface, the extremity whereof scraps the web 115. To activate said roller 132 a third toothed wheel 133 is provided which, together with the toothed wheels 123 and 124 is driven by the motor 125, the batteries 126 being placed in an adjacent compartment 134, at the other end thereof, there being located a spray 128, in turn driven by the segment 107.

Thus, it has been found that the electrically operated self-cleaning ashtray has achieved its objects, removing any residue placed on the web, thereafter re-positioning it at the opening without showing any remaining ash marks. The spray deodourizes the web removing any unpleasant odour therefrom, while the electric motor simplifies the various operations described hereinabove.

The invention as disclosed is susceptible to many modifications and changes, without departing from the purview of the inventive concept.

Thus, for example, the power supply source may be a transformer arranged to replace the batteries, through a circuit, not shown, including a rectifier and terminals for connection with an external A.C. source.

Furthermore, all of the details are replaceable with other, technically equivalent elements.

We claim:

1. A self-cleaning ashtray comprising a box like case, an opening, a spray device, a web, web support means, a collecting bin, drive means, first actuation means and second actuation means, said opening being formed in said box-like case, said web support means being adapted for movably supporting said web in said box-like case, at least a portion of said web being at least temporarily locatable substantially below said opening, said collection bin being located in said box-like case, said web being adapted for transporting material deposited thereon to said collecting bin, said drive means actuatable for causing movement of said web on said web support means at least in a direction extending from below said opening towards said collecting bin, said spray device being accommodated in said box-like case and adapted for being actuated for spraying deodorizing fluid onto said web, said first actuation means and said second actuation means being mounted on said box-like case, said first actuation means being adapted for actuating said spray device, said second actuation means being adapted for actuating said drive means.

2. An ash tray according to claim 1 wherein said spray device comprises a valve, said valve being operable upon actuation of said first actuation element, for causing deodorizing fluid to be atomized and sprayed from said spray device onto said web.

3. An ash tray according to claim 1 wherein said collecting bin is removably accommodated in said box-like case remotely from said opening, said web having defined thereon a discharge area and a renewable flat area, said discharge area substantially overlying said collecting bin, said renewable flat area being at least temporarily locatable substantially below said opening, at least a portion of said web being interposed between said collecting bin and said opening.

4. An ash tray according to claim 1 wherein said web support means comprise a plurality of rollers, said plurality of rollers being rotatably supported in said box-like case and adapted to be powered by said drive means, said web being trained around said plurality of rollers, and adapted to be moved thereon relatively to said opening upon actuation of said second actuation means, said web being further adapted to be sprayed with atomized deodorizing fluid upon actuation of said first actuation means.

5. An ash tray according to claim 4 wherein said web is trained around said plurality of rollers in a closed loop formation.

6. An ash tray according to claim 4 wherein said web has at least one end, at least one other end and an intermediate portion, and wherein said plurality of rollers includes a roller, an other roller, and intermediate rollers, said at least one end of said web being attached to said roller, said intermediate portion of said web being wound several times around said roller and extending over said intermediate rollers to said other roller, said at least one other end of said web being attached to said other roller, actuation of said drive means being adapted for causing said intermediate portion of said web to be unwound from said roller and would around said other roller.

7. An ash tray according to claim 1 wherein said drive means comprise electro-mechanical drive means including an electric motor, a switch, and motion transmission means, said second actuation means being adapted for co-operation with said switch for electrically connecting said electric motor to a source of electrical energy, said electric motor being adapted for generating rotary motion upon actuation of said second actuation means and said switch, said motion transmission means being adapted for transmitting rotary motion generated by said electric motor to said web support means, for causing movement of said web on said web support means.

8. An ash tray according to claim 7 wherein said spray device includes a valve, wherein said electro-mechanical drive means include a switch, and wherein said first actuation means and said second actuation means each comprise a support member and at least one tiltable element, each said support member being rigidly associated with said box-like case, said tiltable element of said first actuation means being adapted for actuating said valve, said tiltable element of said second actuating means being adapted for actuating said switch, actuation of said valve being effective for causing atomized deodorizing fluid to be sprayed from said spraying device onto said web, actuation of said switch in turn causing actuation of said electro-mechanical drive means for generating rotational movement of said web support means and substantially linear movement of at least a portion of said web extending below said opening.

9. An ash tray according to claim 1 further comprising a detergent liquid compartment, and a web contacting roller, said detergent liquid compartment being located in said box-like case below said web and adapted for containing detergent liquid, said web contacting roller being rotatably mounted in said box-like case and adapted, for being at least partially immersed in detergent fluid contained in said detergent fluid compartment and for scraping contact engagement relationship with said web.

10. An ash tray according to claim 9 wherein said web contacting roller is adapted for being rotated by said drive means, upon actuation thereof for causing movement of said web on said web support means.

11. An ash tray according to claim 9 further comprising a sponge and a sponge compartment, said sponge compartment being located in said box-like case and adapted for containing said sponge, said sponge being adapted for wiping contact engagement relationship with said web.

12. An ash tray according to claim 1 wherein said first actuation means and said second actuation means are externally, upwardly mounted on said box-like case, and wherein said opening is formed in said box-like case between said first actuation means and said second actuation means at a location substantially overlying at least a portion of said web.

13. An ash tray according to claim 1 further comprising a bearing deck, said bearing deck being rigidly mounted in said box-like case, below at least a portion of said web located below said opening.

* * * * *